US006427388B1

(12) United States Patent
Brochu

(10) Patent No.: US 6,427,388 B1
(45) Date of Patent: Aug. 6, 2002

(54) GUTTER SHIELD

(76) Inventor: Stephane Brochu, 890 Beaulieu St., St-Jean-Chrysostome, QC (CA), G6Z 2L1

( * ) Notice: Subject to any disclaimer, the term of this patent is extended or adjusted under 35 U.S.C. 154(b) by 0 days.

(21) Appl. No.: 09/853,555

(22) Filed: May 11, 2001

(30) Foreign Application Priority Data

Jan. 26, 2001 (CA) ..... 2332485

(51) Int. Cl.[7] ..... E04D 13/076
(52) U.S. Cl. ..... 52/12
(58) Field of Search ..... 52/11, 12; 210/474; 248/48.1, 48.2

(56) References Cited

U.S. PATENT DOCUMENTS

| | | | | | |
|---|---|---|---|---|---|
| 669,495 | A | * | 3/1901 | Babcock | 210/474 |
| 1,526,821 | A | * | 2/1925 | Andrews | 52/12 X |
| 2,613,621 | A | * | 10/1952 | Schraeder | 52/12 |
| 2,636,458 | A | * | 4/1953 | Harris | 52/12 X |
| 3,351,206 | A | * | 11/1967 | Wennerstrom | 210/474 |
| 3,428,183 | A | * | 2/1969 | Bristow | 210/474 |
| 4,592,174 | A | * | 6/1986 | Hileman | 210/474 |
| 4,888,920 | A | * | 12/1989 | Marulic | 52/11 X |
| 4,937,986 | A | * | 7/1990 | Way, Sr. et al. | 210/474 |
| 5,056,276 | A | * | 10/1991 | Nielsen et al. | 210/474 |
| 5,072,551 | A | * | 12/1991 | Manoogian, Jr. | 52/12 X |
| 5,566,513 | A | * | 10/1996 | Herren | 210/474 |
| 5,842,311 | A | * | 12/1998 | Morin | 52/12 |
| 6,205,715 | B1 | * | 3/2001 | Rex, Jr. | 52/12 |

FOREIGN PATENT DOCUMENTS

| | | | | |
|---|---|---|---|---|
| DE | 3905961 | * | 9/1989 | 52/12 |
| JP | 3-140556 | * | 6/1991 | 52/11 |

* cited by examiner

*Primary Examiner*—Laura A. Callo
(74) *Attorney, Agent, or Firm*—Eric Fincham

(57) ABSTRACT

A gutter shield for protecting a gutter comprising a mounting means secured to the gutter, a guard member having an elongated configuration with a plurality of apertures extending therethrough for drainage into the gutter, a first side of the guard member being engageable with the mounting member to prevent substantial vertical movement while permitting horizontal movement thereof to allow adjustment of the guard member for an individual gutter width. The device is suitable for many different sizes of gutters.

14 Claims, 3 Drawing Sheets

GUTTER SHIELD

FIELD OF THE INVENTION

The present invention relates to a shield for a rainwater gutter assembly or a eaves trough.

BACKGROUND OF THE INVENTION

The use of shields for gutters or eaves troughs is well known in the prior art and there have been many proposals for different types of shields. The purpose of the shield is essentially to permit passage of rainwater from the roof to the eaves trough while protecting the same from extraneous foreign matter such as leaves and the like.

To date, there have been several different approaches taken. A first approach is utilizing a shield or a guard which is apertured and permits the passage of rainwater while ostensibly barring the passage of extraneous material. However, many of these guards do not function as desired and access must still be had to the eaves trough for cleaning purposes. Also, each one must be fabricated to the particular size of eaves trough.

It has also been proposed in the art to provide relatively complex structures wherein the eaves troughs are mounted for rotatable movement such that they may be emptied at desired intervals.

There have also been proposed gutters having a design wherein a cover has an outer edge which curls downwardly and the water flow follows the curved portion due to surface tension to cascade into the eaves trough. However, this concept will not necessarily work when the volume of water becomes sufficiently large that the surface tension is insufficient to cause all the water to flow into the gutter.

SUMMARY OF THE INVENTION

It is an object of the present invention to provide a novel gutter guard which is designed to fit many different sizes of eaves troughs.

It is a further object of the present invention to provide a gutter for a eaves trough wherein the rainwater may enter the gutter but virtually all foreign matter is excluded.

According to one aspect of the present invention, there is provided a device for protecting a gutter wherein the gutter has a rear wall, a front wall, a bottom wall, the walls defining a trough therebetween, the device comprising a mounting member, means for securing the mounting member to the gutter, a guard member having an elongated configuration with first and second longitudinally extending opposed sides, a first side of the guard member being engageable with the mounting member to prevent substantial vertical movement of the guard member while permitting horizontal movement thereof to allow adjustment of the guard member for an individual gutter width, and wherein the guard member has a substantially planer portion between the first and second sides, the substantially planer portion having a plurality of apertures extending therethrough.

According to a further aspect of the present invention, there is provided, in combination, a gutter having a rear wall, a front wall, and a bottom wall, the rear wall, front wall and bottom wall defining an open top trough, the gutter being attached to a structure by means of an attaching member extending through the front and rear walls to the structure, and a device for protecting the gutter, the device comprising a mounting member, means for securing the mounting member to the attaching member, a guide member having an elongated configuration with first and second longitudinally opposed sides, a first side of the guard member being engageable with the mounting member to prevent substantial vertical movement of the guard member while permitting horizontal movement thereof to allow adjustment of a width of the guard member between the front and rear walls, and wherein the guard member has a substantially planer portion between the first and second sides, the substantially planer portion having a plurality of apertures extending therethrough.

The device of the present invention may be formed of any suitable material and would conveniently be formed either of a metallic or plastic material. Thus, both materials are known for use in gutters and one may use either a similar or dissimilar material.

The device of the present invention provides a guard for the eaves trough to prevent foreign matters from entering into the eaves trough through the appropriate sizing of the apertures formed therein. In this respect, the aperture size and their placement permit them adequate drainage of the water through the apertures into the eaves trough while substantially excluding a foreign matter which remains on the top and would normally be removed by wind and the like. The size of the apertures prevents clogging of the device.

The apertures preferably extend in diagonal lines at an angle of 45° with respect to the gutter length. In the preferred embodiments, the apertures have an aperture of between 2.5 and 10 mm and even more preferably between 3.0 and 4.0 mm. As the apertures are arranged in diagonal rows, they are also preferably arranged in longitudinally extending rows. In a longitudinally extending row, the apertures are spaced apart by a distance of between 10 and 15 mm while in a diagonal row, they are spaced apart by a distance of between 5 and 10 mm.

As will be appreciated, during a period of heavy rain or the like, the drainage may not be instantaneous and accordingly, there is preferably provided a vertically extending wall adjacent the front wall of the gutter to prevent overflow.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
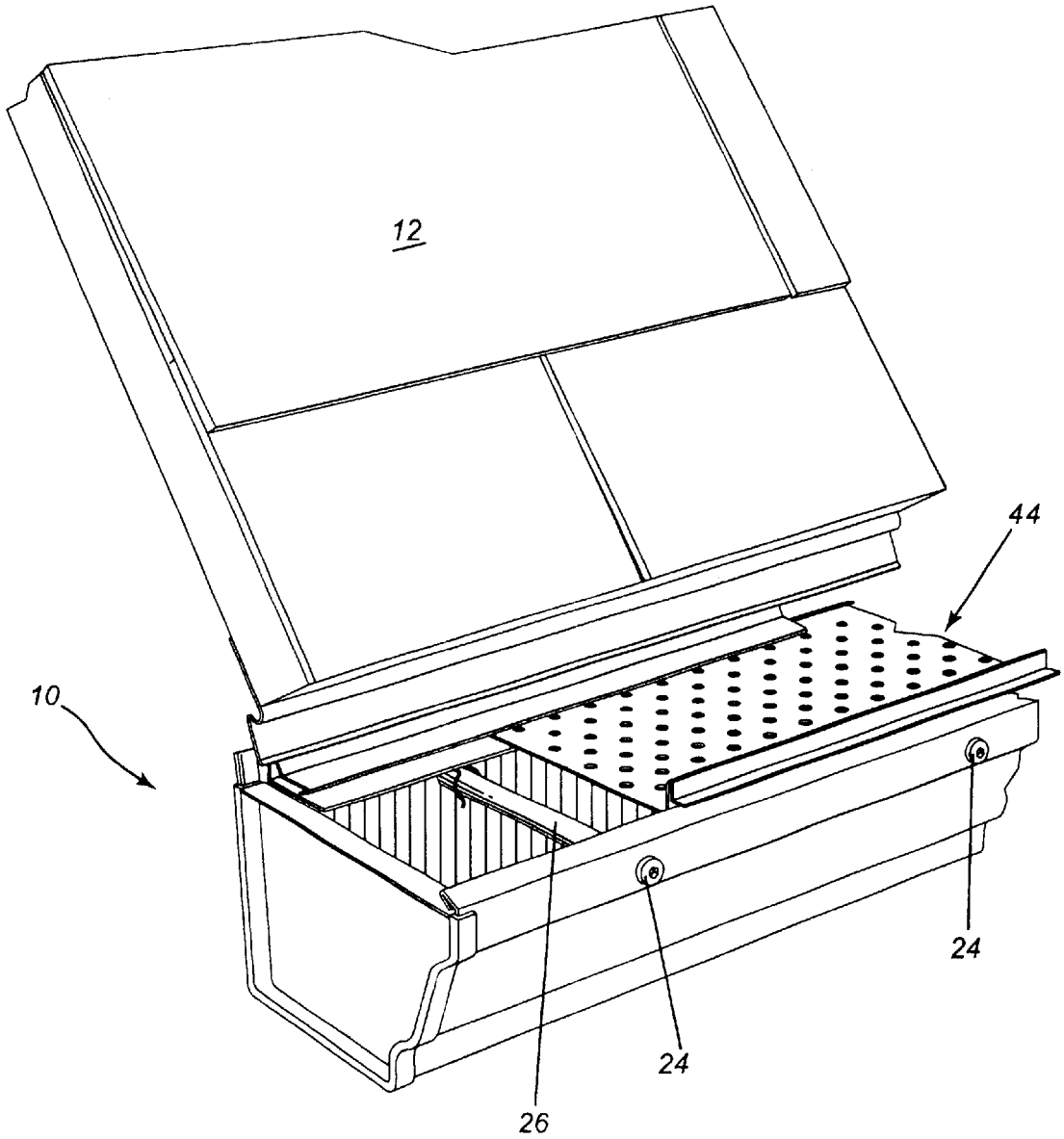
FIG. 1 is a perspective view of a portion of a device according to one embodiment of the present invention, showing the gutter and device secured in place.
Figure 2:
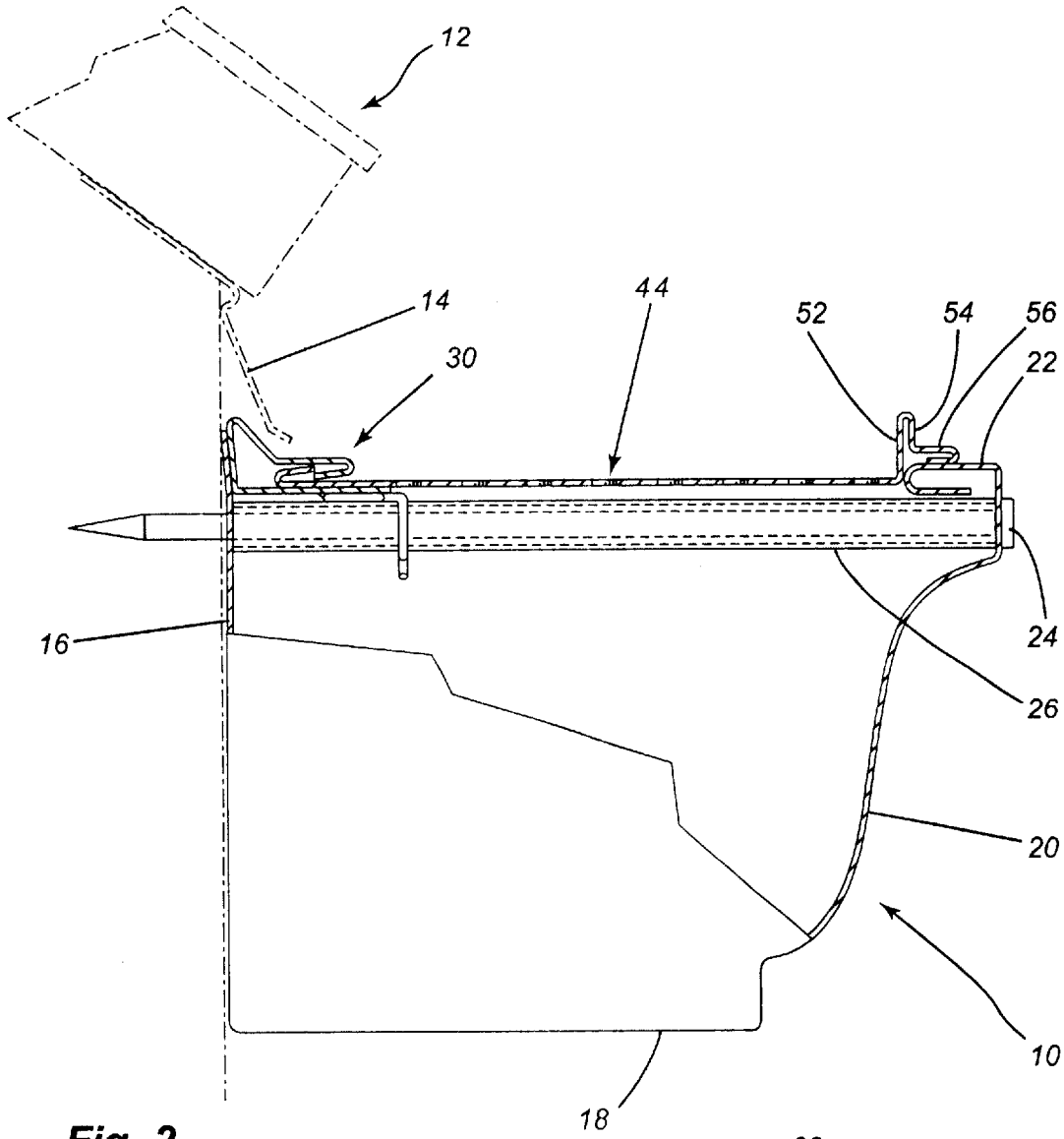
FIG. 2 is an end cross sectional view of the gutter and device shown in FIG. 1.

Referring to the drawings in greater detail and by reference characters thereto, it is illustrated a gutter generally designated by reference numeral 10 and which is attached to a roof generally designated by reference numeral 12. As is conventional, there is provided a drip edge 14 extending from under the edge of the roof.

Gutter 10 is a conventional gutter and includes a back wall 16 lying substantially adjacent to the facia of the structure. Extending between a front wall 20 and back wall 16 is a bottom 18. Front wall 20 includes a front top wall 22 which extends horizontally inwardly and which is folded under to present a finished edge as is conventional. Gutter 10 is secured by means of nails 24 which pass through an internal shroud 26, again as is well known in the art.

The device of the present invention includes a first member generally designated by reference numeral 30 and which will now be referred to. First member 30 has a bottom portion 32 which extends through a radius into a side wall 34. First member 30 also includes an outwardly tapering section 36 arcuately merging with side wall 34. Outwardly tapering section 36 continues to a horizontal top wall portion 38. Finally, there is a flange 40 which extends inwardly. A V-shaped recess 42 is defined within first member 30.

The device also includes a second member 44 which includes a main planar body portion 46 which has a plurality of apertures 48 formed therein. Apertures 48, as may be seen, extend in diagonal lines at an angle of 45 degrees with respect to the length of the body 46. For a best functioning of the device, the sizing and placement of the apertures is important. The apertures preferably have a diameter of between 2.5 and 10 mm and more preferably between 3.0 and 4.0 mm. Also, the spacing is preferably such that in a longitudinally extending row, the apertures are spaced between 10 and 15 mm apart with a spacing of between 5 and 10 mm in a diagonal row. It has been found that these spacings and sizes of apertures permit water to flow into the gutter while the sizes are such that substantially all foreign matter is excluded.

The second member 44 includes a flange 50 which extends inwardly along one side of body 46 for reasons which will become apparent hereinbelow. Flange 50, together with body portion 46, defines a V-shaped configuration.

At its other side, body 46 has a vertical inner wall 52 which is radiused to join a vertical outer wall 54. A horizontal portion 56 extends outwardly from vertical outer wall 54 and terminates in a reverse edge.

Figure 3:
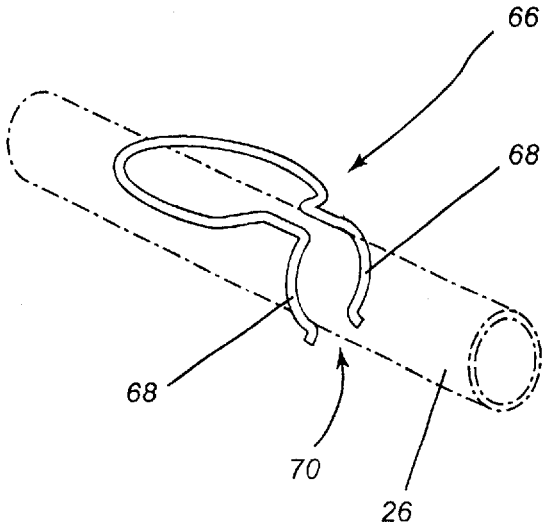
FIG. 3 is a perspective view showing one embodiment of a mounting member according to the present invention.

In use, first member 30 is secured adjacent rear wall 16 of gutter 10. To this end, there are provided clip members 66 which are secured to the underside of wall 32 of first member 30. In one embodiment, as shown in FIG. 3, each clip member 66 comprises a pair of inwardly facing C-shaped elements 68 defining an opening 70 therebetween. These are then mounted on shroud 26 surrounding a nail 24.

Figure 4:
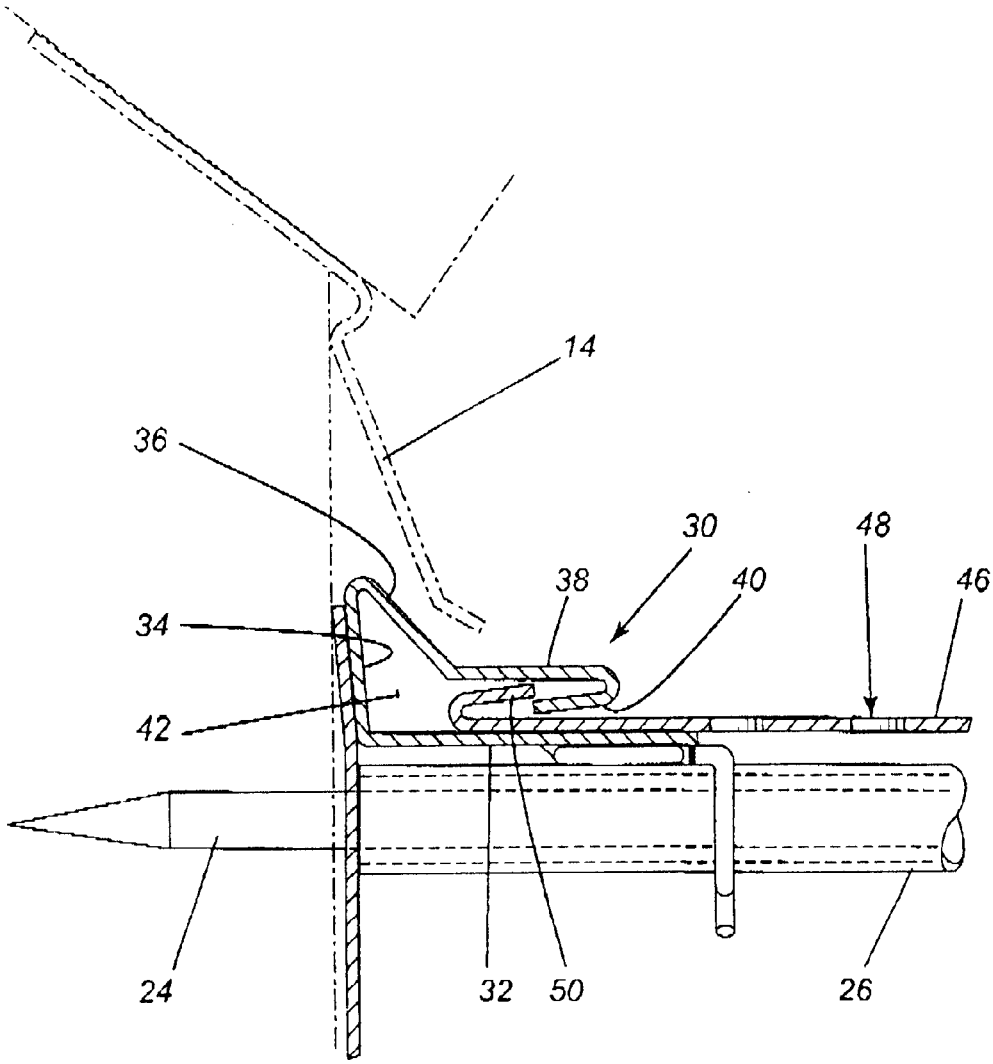
FIG. 4 is an enlarged view of a portion of FIG. 2 showing the mounting member.

As may be seen in FIG. 4, the end of body 46 having flange 50 may be inserted into the cavity 42. It is then movable to provide for an adjustable width. The flanges 40 and 50 will prevent withdrawal of second member 44.

Vertical inner side wall 52 forms a barrier to prevent overflow of the rainwater from the surface of body portion 46.

It will be understood that the above described embodiment is for purposes of illustration only and that changes or modifications may be made thereto without departing from the spirit and scope of the invention.

I claim:

1. A device for protecting a gutter wherein the gutter has a rear wall, a front wall, a bottom wall, said walls defining a trough therebetween, said device comprising:

a mounting member, means for securing said mounting member to said gutter;

a guard member having an elongated configuration with first and second longitudinally extending opposed sides;

a first side of said guard member being engageable with said mounting member to prevent substantial vertical movement of said guard member while permitting horizontal movement between said mounting member and said guard member to allow adjustment of said guard member for an individual gutter width;

wherein said means for securing said mounting member to said gutter comprises a securing member designed to be attached to a gutter retaining member extending between said rear wall and said front wall; and wherein said guard member has a substantially planer portion between said first and second sides, said substantially planer portion having a plurality of apertures extending therethrough.

2. The device of claim 1 wherein said apertures are arranged in diagonal rows extending between said first and second opposed sides.

3. The device of claim 1 wherein said apertures are circular in configuration, said apertures having a diameter of between 2.5 and 10 mm.

4. The device of claim 3 wherein said apertures have a diameter of between 3.0 and 4.0 mm.

5. The device of claim 3 wherein said diagonal rows extend at an angle of 45° with respect to said first and second opposed sides, said apertures forming longitudinally extending rows, said apertures being spaced apart by a distance of between 10 and 15 mm in said longitudinally extending rows.

6. The device of claim 5 wherein said apertures are spaced apart by between 5 and 10 mm in each diagonal row.

7. The device of claim 1 wherein said mounting member has a recess facing said first side of said guard member whereby said first side of said guard member is insertable into said recess and is moveable therein.

8. The device of claim 7 wherein said mounting member has means for retaining said first side of said guard member in said recess.

9. The device of claim 8 wherein said means for retaining said first side comprises a V-shaped member formed within said recess and a cooperating V-shaped member formed on said one side of said guard member.

10. The device of claim 1 wherein said device has a vertically extending side wall adjacent said second side.

11. In combination, a gutter having a rear wall, a front wall, and a bottom wall, said rear wall, front wall and bottom wall defining an open top trough, said gutter being attached to a structure by means of an attaching member extending through said front and rear walls to said structure, and a device for protecting said gutter, said device comprising:

a mounting member, means for securing said mounting member to said attaching member;

a guard member having an elongated configuration with first and second longitudinally opposed sides;

a first side of said guard member being engageable with said mounting member to prevent substantial vertical movement of said guard member while permitting horizontal movement between said mounting member and said guard member to allow adjustment of a width of said guard member between said front and rear walls; and wherein said guard member has a substantially planer portion between said first and second sides, said substantially planer portion having a plurality of apertures extending therethrough.

12. The device of claim 11 wherein said apertures are circular in configuration, said apertures having a diameter of between 2.5 and 10 mm.

13. The device of claim 12 wherein said mounting member has a recess facing said first side of said guard member whereby said first side of said guard member is insertable into said recess and horizontally movable therein.

14. The device of claim 13 wherein said first side of said guard member has a V-shaped portion formed thereon, said mounting member having a cooperating V-shaped member to retain said first side of said guard member in said recess.

* * * * *